US006053130A

United States Patent [19]

Shellenberger

[11] Patent Number: 6,053,130

[45] Date of Patent: Apr. 25, 2000

[54] POWER VENT WATER HEATER WITH ELECTRONIC CONTROL SYSTEM

[75] Inventor: Timothy J. Shellenberger, Johnson City, Tenn.

[73] Assignee: American Water Heater Company, Johnson City, Tenn.

[21] Appl. No.: 09/090,638

[22] Filed: Jun. 4, 1998

[51] Int. Cl.[7] ..... F22B 37/42

[52] U.S. Cl. ..... 122/504; 122/13.1; 122/14; 122/17; 110/162

[58] Field of Search ..... 122/13.1, 14, 17, 122/504; 126/91 A, 350 R; 110/162

[56] References Cited

U.S. PATENT DOCUMENTS

| | | | |
|---|---|---|---|
| 3,587,490 | 6/1971 | Martin | 110/162 |
| 4,205,631 | 6/1980 | Parker | 110/162 |
| 4,401,261 | 8/1983 | Brown . | |
| 4,426,993 | 1/1984 | Hoyme . | |
| 4,672,919 | 6/1987 | Staats . | |
| 4,757,802 | 7/1988 | Guzorek . | |
| 4,906,178 | 3/1990 | Goldstein et al. . | |
| 4,981,262 | 1/1991 | Jackson . | |
| 5,012,793 | 5/1991 | Guzorek . | |
| 5,199,385 | 4/1993 | Doss | 110/162 |
| 5,255,665 | 10/1993 | Windon . | |
| 5,616,995 | 4/1997 | Hollenbeck | 110/162 |
| 5,628,303 | 5/1997 | Ahmady et al. | 126/91 A |
| 5,720,231 | 2/1998 | Rowlette et al. | 110/162 |
| 5,797,358 | 8/1998 | Brandt et al. . | |

*Primary Examiner*—Teresa Walberg
*Assistant Examiner*—Jiping Lu
*Attorney, Agent, or Firm*—Schnader Harrison Segal & Lewis

[57] ABSTRACT

A water heater of the invention includes a water container; a combustion chamber adjacent the water container; a burner associated with the combustion chamber; a flue connected to the combustion chamber; a blower assembly positioned to receive combustion products from the flue and convey the combustion products to a remote location; and a pressure switch positioned to detect blockage of combustion products away from the blower assembly and flow of air from the flue prior to initiation of combustion in the combustion chamber.

35 Claims, 5 Drawing Sheets

10
55
52
54
50
42
48
18
46
38
12
72
14
74
44
40
32
41
30
28
16
36
20
22
26
24

POWER VENT WATER HEATER WITH ELECTRONIC CONTROL SYSTEM

FIELD OF THE INVENTION

This invention relates to a gas-fired water heater, particularly to a power vent gas water heater having an electronic control system.

BACKGROUND OF THE INVENTION

Typical gas-fired water heaters are constructed for installation and operation in indoor spaces such as basements, garages, laundryrooms, closets and the like. Many such constructions do not have a chimney available for use as a means to exhaust flue gases or products of combustion from the water heater. Accordingly, other flue exhaust systems have been developed which exhaust flue gases from the building in an alternate manner. Representative examples include the water heaters disclosed in U.S. Pat. Nos. 4,672,919 and 5,255, 665.

Since such water heaters do not utilize the natural draft afforded by a chimney, such water heaters are equipped with fans or blowers to assist the flue gases or combustion products from the upper portion of the water heater outwardly of the building. The presence of the fans or blowers presents the potential for flue gases to exhaust into the interior space if the fan or blower is not working properly or if there is blockage of the conduit extending from the fan or blower to the exterior of the building. Thus, various measures have been taken to help increase the safety factor in the operation of such water heaters.

Various detection systems have been devised to accomplish the safety goal. For example, U.S. Pat. No. 4,672,919 includes a pair of thermostats on the blower assembly, one on the top and one on the bottom, to detect blockage of the vent system. Separately, a pressure switch connected to the control valve actuates the blower when the control valve supplies gas to the main burner.

Unfortunately, control systems of this type are relatively complex from the both the mechanical and electrical perspectives. Such complexity results in a relatively large number of parts required to perform the necessary operational and safety functions. The increased number of parts results in assembly-line complexity, which increases labor costs as well as costs of materials.

Typical water heaters also utilize electro-mechanical thermostat units to detect the temperature of water in the water tank. Such thermostats have wide temperature set-point tolerances that result in wide variations in water temperatures and increased response times.

OBJECTS OF THE INVENTION

It is an object of the invention to provide a water heater capable of a high degree of operational safety.

It is another object of the invention to provide a water heater that has a simple control system requiring a minimal number of parts.

It is yet another object of the invention to provide a water heater that is capable of closely controlling the temperature of water within the water heater to increase energy efficiency and speed recovery time.

Other objects and advantages of the invention will become apparent to those skilled in the art from the drawings, the detailed description of the invention and the appended claims.

SUMMARY OF THE INVENTION

A water heater of the invention includes a water container; a combustion chamber adjacent the water container; a burner associated with the combustion chamber; a flue connected to the combustion chamber; a blower assembly positioned to receive combustion products from the flue and convey the combustion products to a remote location; and a pressure switch positioned to detect blockage of combustion products away from the blower assembly and flow of air from the flue prior to initiation of combustion in the combustion chamber.

DETAILED DESCRIPTION OF THE INVENTION

Figure 1:
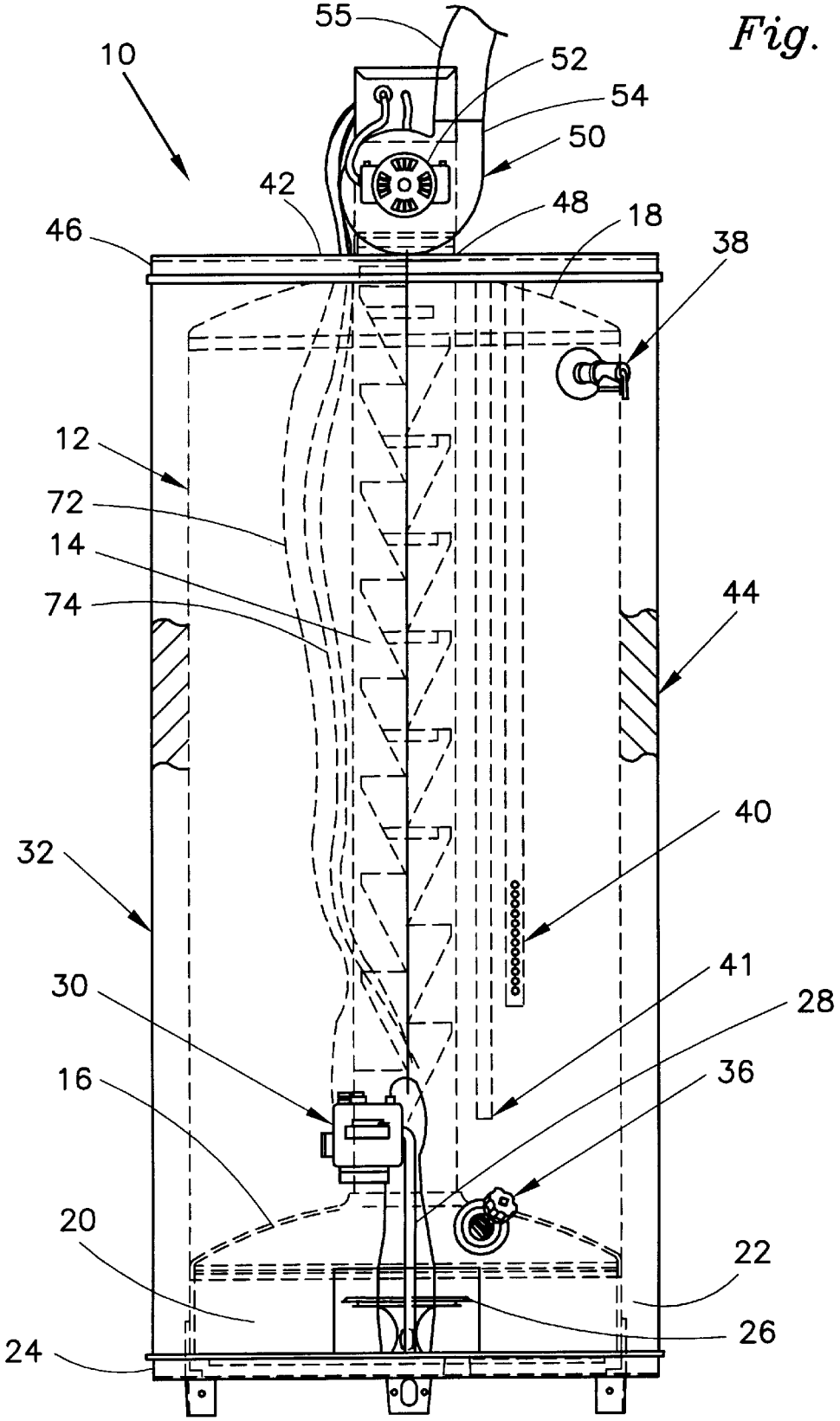
FIG. 1 shows a front elevational view, partly taken in section, of a water heater in accordance with aspects of the invention, the dash lines indicating interior components.

It will be appreciated that the following description is intended to refer to the specific embodiments of the invention selected for illustration in the drawings and is not intended to define or limit the invention, other than in the appended claims.

Turning now to the drawings in general and FIG. 1 in particular, the number "10" designates a gas-fired water heater of the invention. Water heater 10 is formed from a water tank 12 having a flue tube 14 extending between tank bottom 16 and tank head 18. A combustion chamber 20 is located beneath tank bottom 16 and formed from sidewall 22, bottom pan 24 and tank bottom 16. A gas-fired burner 26 is located within combustion chamber 20 and connects to a fuel line 28 which connects to a fuel valve 30. Fuel valve 30 is mounted onto jacket 32 and connects to a sensor 76.

A top pan 46 connects to the upper portion of jacket 32 and contains opening 48 through which flue tube 14 extends. A water inlet 40 and anode 41 extend into a lower portion of tank 12 through top pan 46. Similarly, a water outlet 42 extends into an upper portion of tank 12 and outwardly of top pan 46. Foam insulation 44 is located between jacket 32 and tank 12, and between top pan 46 and tank head 18. A drain valve 36 connects into a lower portion of tank 12 and extends outwardly through jacket 32. Similarly, a T&P valve connects to an upper portion of tank 12 and extends outwardly through jacket 32.

Figure 2:
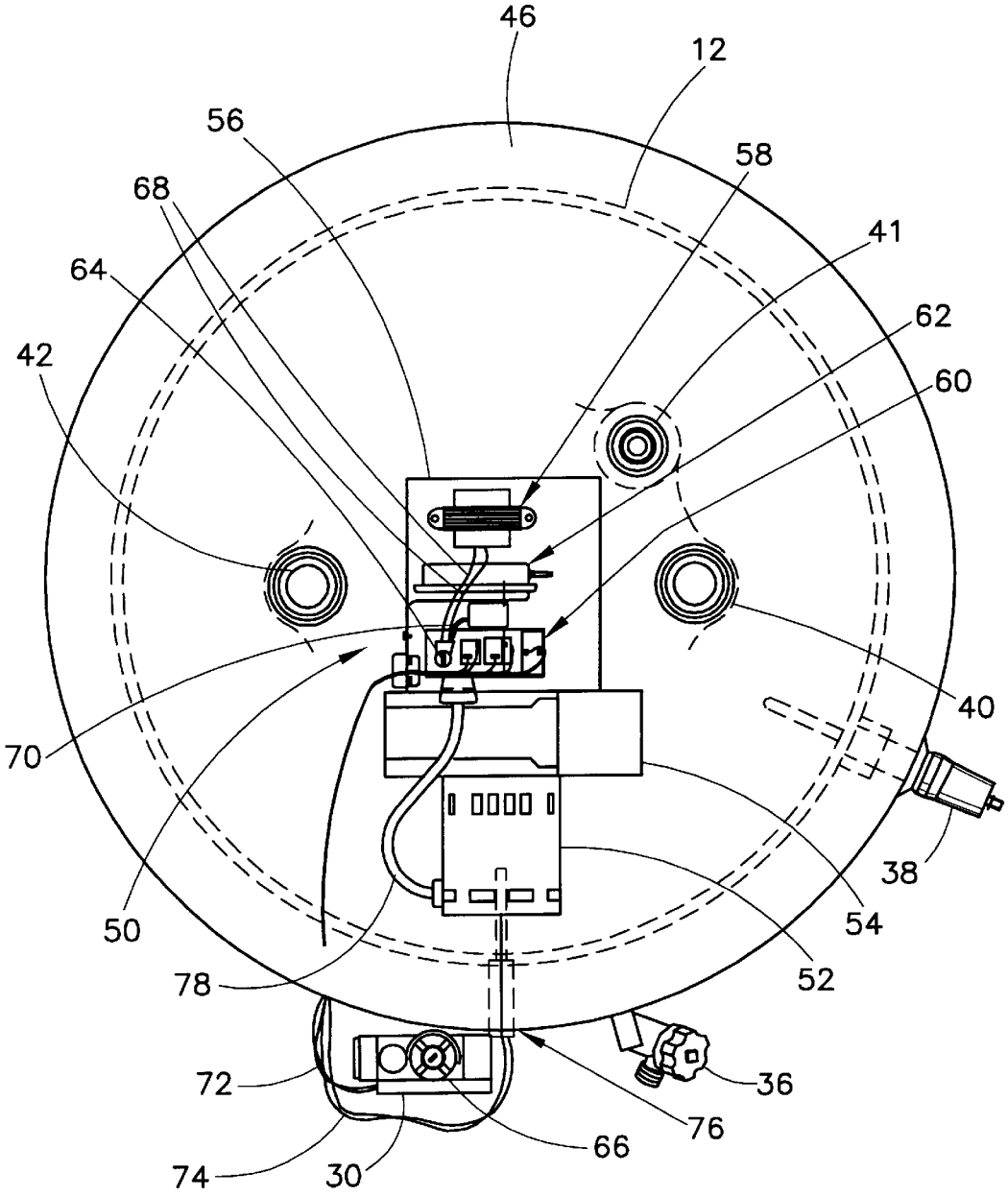
FIG. 2 shows a top plan view of the water heater of FIG. 1.

FIGS. 1 and 2 show a blower assembly 50 positioned on top pan 46 and positioned over opening 48 to receive flue gases or combustion products from flue tube 14. Blower assembly 50 includes an electric motor 52 which powers blower 54 and an exhaust conduit 55. A flue gas collection box 56 connects to blower 54 and is directly positioned over opening 48. A transformer 58, electronic controller 60 and pressure switch 62 are positioned above flue gas collection box 56. Electronic controller 60 is equipped with a temperature adjuster 64. Similarly, fuel valve 30 is equipped with a on-off-pilot switch 66.

As shown in FIGS. 1–4, wires 68 connect between transformer 58 and electronic controller 60. Similarly, wires 70 connect between pressure switch 62 and controller 60. Wires 72 connected between electronic controller 60 and fuel valve 30. Wires 74 also connect between electronic controller 60 and thermistor unit 76. Cord 78 connects between electric motor 52 and electronic controller 60.

Figure 3:
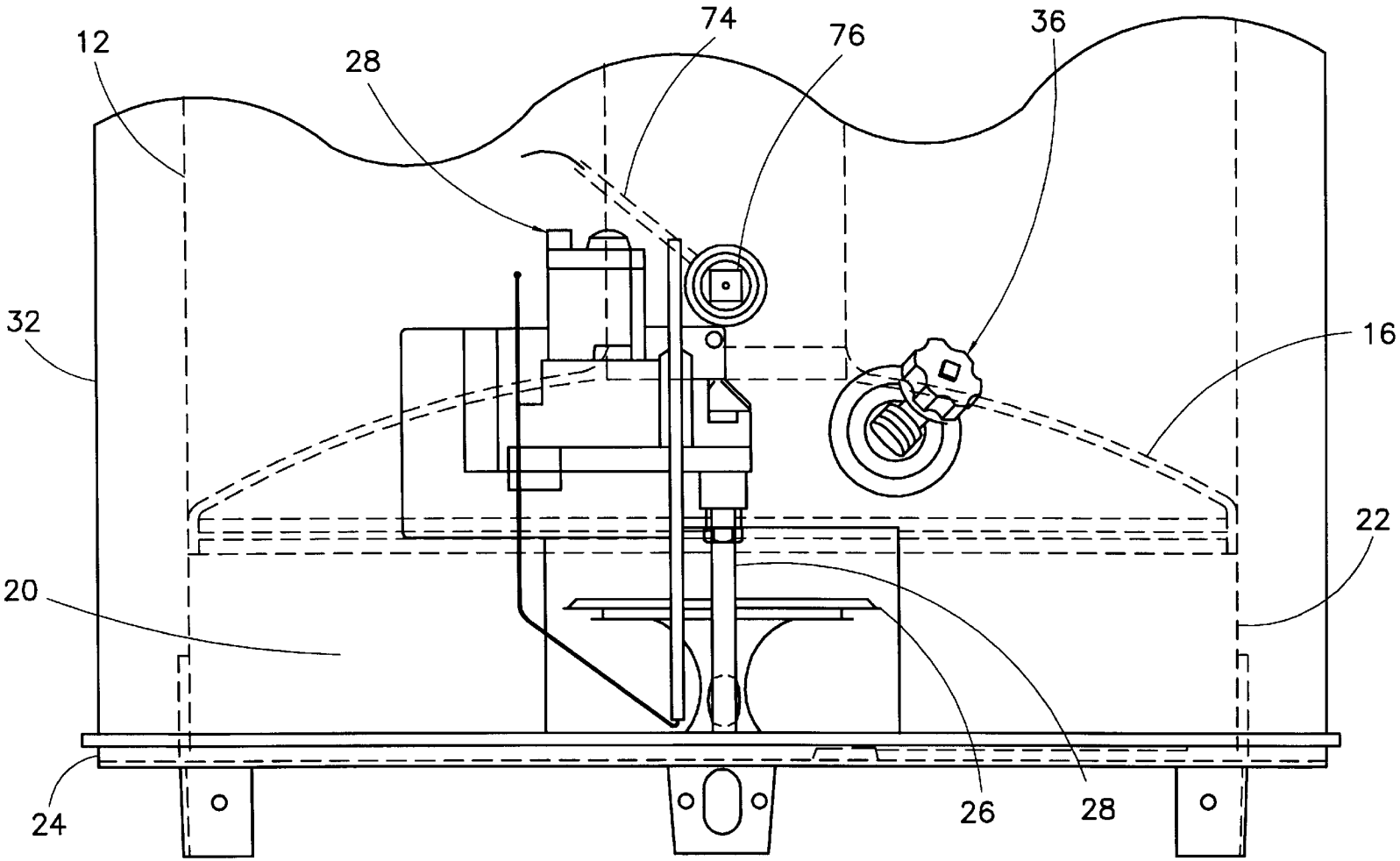
FIG. 3 shows an exploded front elevational view of the lower portion of the water heater shown of FIG. 1.
Figure 4:
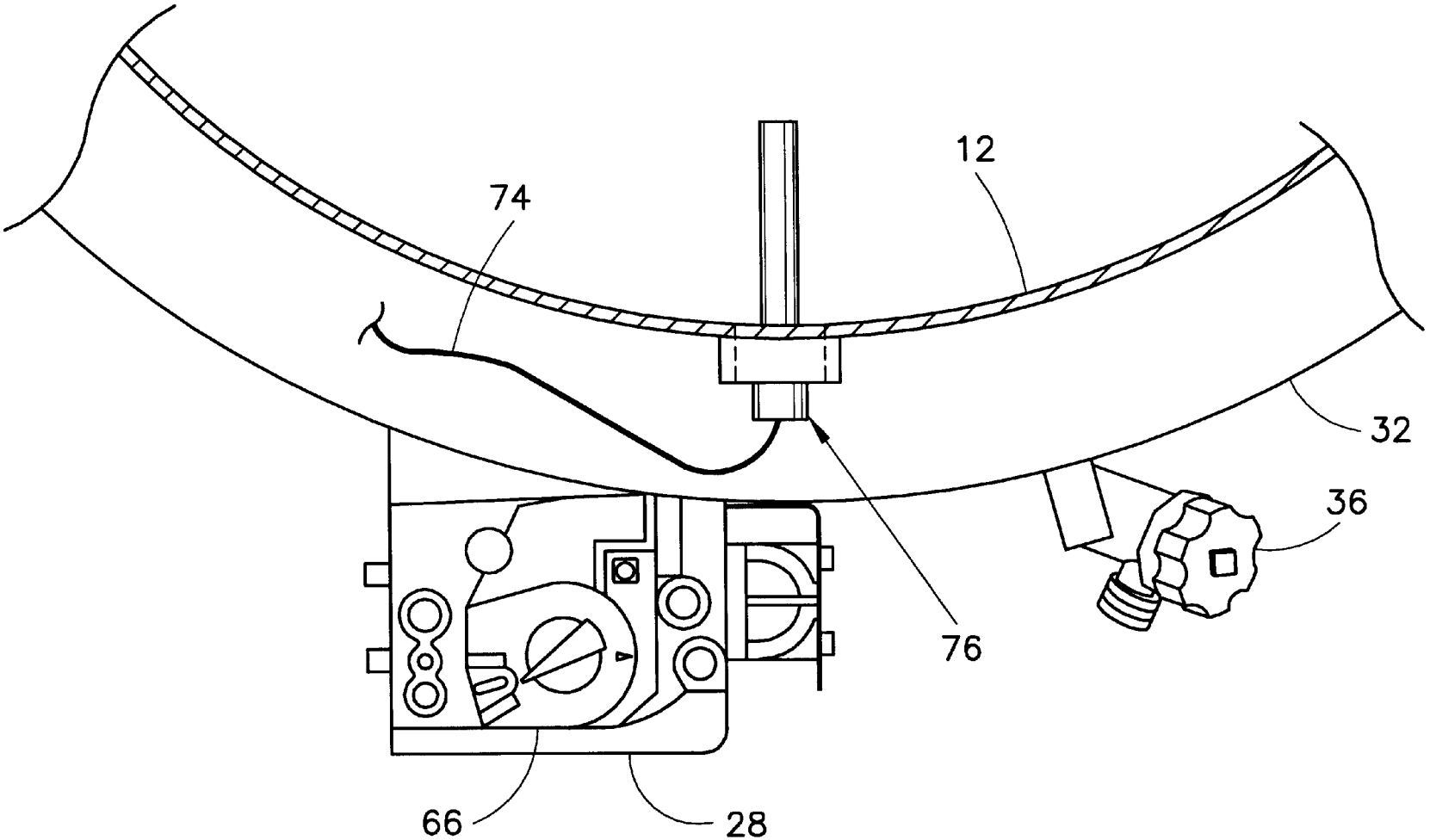
FIG. 4 shows a portion of the front of a water heater shown from above, with emphasis on the placement of the water temperature sensor on the water heater water tank.

FIGS. 3 and 4 show exploded views of the positioning of thermistor unit 76 in relation to fuel valve 30 from the side and the top, respectively. Thermistor unit 76 is preferably located near the bottom portion of tank 12, and is elevated just above tank bottom 16. Thermistor unit 76 is inserted through the wall of tank 12 and extends inwardly into tank 12 to sense the temperature of the water.

Figure 5:
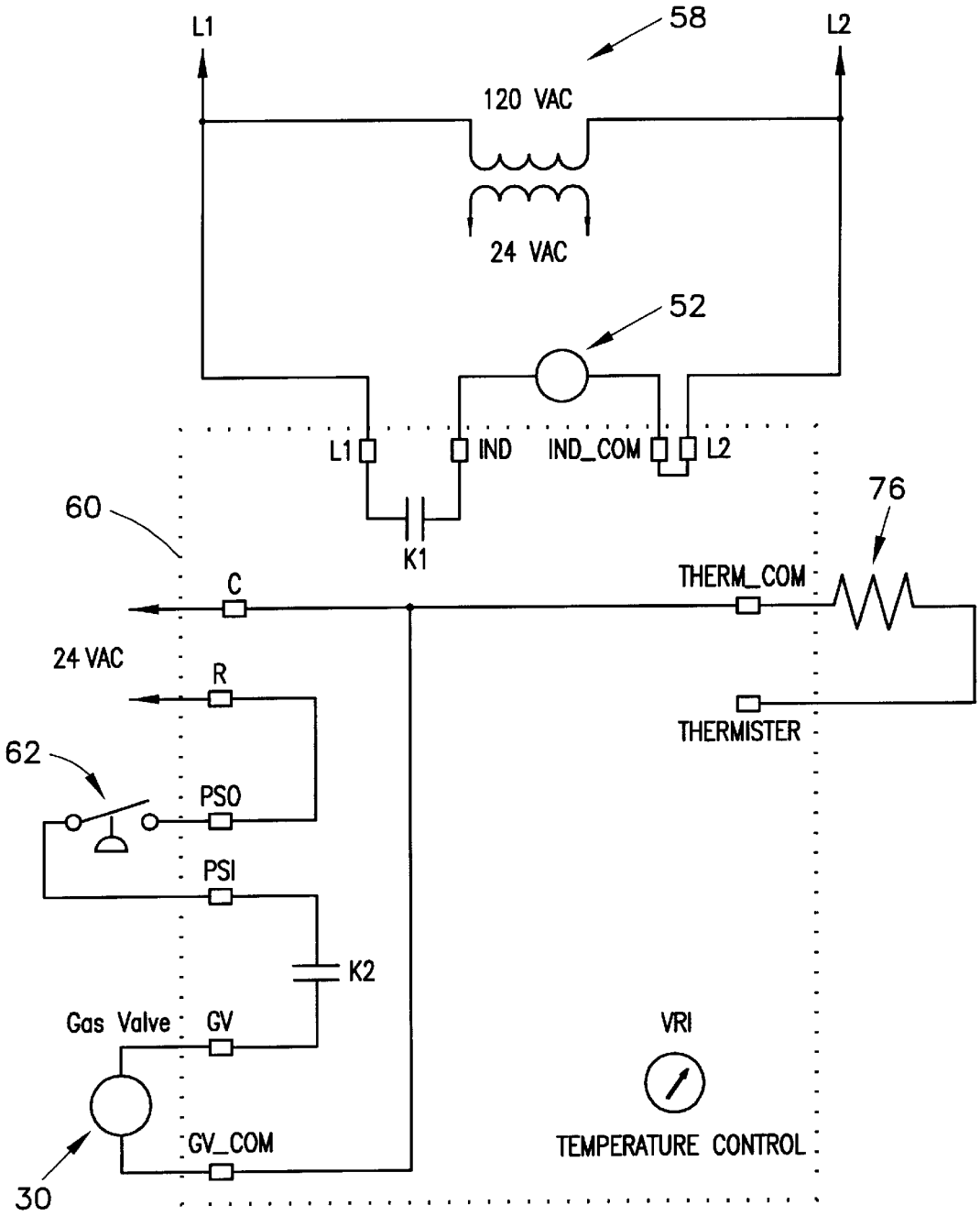
FIG. 5 is an electrical schematic of the control system of a water heater in accordance with aspects of the invention.

FIG. 5 is a schematic showing a preferred configuration of controller 60. Controller 60 preferably incorporates electronic control circuitry for controlling operation of the water heater, as described in more detail below. Such control circuitry may incorporate a number of electronic components, well known to those of ordinary skill in the art, such as solid state transistors and accompanying biasing components, or one or more equivalent programmable logic chips. The electronic control circuitry may also incorporate a programmable read only memory (PROM), random access memory (RAM) and a microprocessor.

The arrangement and/or programming of these components may take any number of forms well known to those of ordinary skill in the art to accomplish operation of the water heater. As shown in FIG. 5, power is supplied to controller 60 and to electric motor 52 through transformer 58. Power may be supplied to transformer 58 from household current, which is typically 120 VAC. Transformer 58 preferably reduces the voltage supplied to controller 60 to 24 VAC. Electrical power is supplied to transformer 58 at points L1 and L2 and to controller 60 itself at points R and C. Additional components may also be used in supplying power to controller 60 from transformer 58, such as resistive elements to prevent overheating of the controller from a large current draw, and/or one or more blocking capacitors. Such elements are, of course, well known to those of ordinary skill in the art.

Pressure switch 62 is connected to controller 60 at points PS0 and PS1. Gas valve 30 is connected to controller 60 at points GV and GV COM. Electric motor 52 is connected to controller 60 at points IND and IND COM. Thermistor unit 76 is also connected as shown. Additional circuitry may also be included, such as capacitive elements, K1 and K2, well known to those in the art.

The physical implementation of these connections is shown in FIG. 2, along with the inclusion of temperature adjuster 64 for setting the water temperature set points. Temperature adjuster 64 is preferably a rotary dial attached to a variable resistor or potentiometer, and is connected in a conventional manner to the circuitry of controller 60.

Temperature adjuster 64 is used in connection with the circuitry of controller 60 to control operation of the water heater of the invention, as described below in connection with the drawings.

Withdrawal of hot water from water outlet 42 results in simultaneous introduction of cold water into tank 12 through water inlet 40. Thermistor 76 detects temperature changes and feeds temperature information to controller 60. Controller 60 checks pressure switch 62 to determine whether or not the pressure switch contacts are open. If pressure switch 62 is in an open condition, controller 60 provides an output to energize electric motor 52, thereby causing blower 54 to actuate and draw air into collection box 56 from flue 14 through opening 48. Controller 60 continues to monitor pressure switch 62 until the pressure switch contacts close. If air is not flowing from flue 14 and/or exhaust line 55 because of blockage, the pressure switch contacts remain open, thereby preventing initiation of a prepurge cycle and the energizing of fuel valve 30.

Once the pressure switch contacts close, controller 60 initiates the prepurge cycle, preferably the prepurge being about eight seconds, after pressure switch 62 closes. Controller 60 then provides an output to fuel valve 30 to energize it so that fuel can be supplied through fuel line 28 to burner 26. Simultaneously, thermistor 76 continues to monitor the temperature of water within tank 12. When thermistor 76 sends temperature information to controller 60 that matches the preset water temperature, controller 60 provides an output to fuel valve 30 and electric motor 52 for them to deenergize.

The water temperature set points are variably adjustable and are preferably about 90–180° F.

Controller 60 includes a lock-out system that is initiated when the water temperature within tank 12 reaches a predetermined temperature, preferably less than or equal to about 210° F. This is known as an over-temperature condition. This temperature is determined by an input signal received from thermistor 76. Upon receiving such an input, controller 60 provides an output which deenergizes all electrical components. The system lock-out can only be reset by removing power, preferably for more than one second, and then reapplying power to the water heater unit.

Controller 60 may also be adapted to be compatible with a relay board used in an air handler for a combination water heating/air heating system. The relay board (not shown) of such a system provides outputs for the blower motor (heat and cool speeds), water circulating pump, electronic air cleaner and humidifier. The input function to the relay board would be from the conventional room thermostat. Controller 60 in such a case can receive temperature information from the relay board and shut down or terminate the supply of hot water to the air heating system when the received temperature information exceeds a predetermined level.

Although this invention has been described in connection with specific forms thereof, it will be appreciated that a wide variety of equivalents may be substituted for the specific elements described herein without departing from the spirit and scope of this invention as described in the appended claims. For example, water tank 12 may be of any number of sizes and may be made from a wide variety of materials such as metals and/or plastics. Foam insulation 44 may similarly be made from any number of foam insulations well known in the art. Top pan 46, jacket 32 and bottom pan 24 may be made from coated steel, plastics or the like. Burner 26 may be operated from a wide variety of fuels including natural gas, propane, liquified natural gas, oil and the like. Different sizes and shapes of electric motor 52 may be employed depending on the size and configuration of the water heater.

What is claimed is:

1. A water heater comprising:

a water container;

a combustion chamber adjacent said water container;

a burner associated with said combustion chamber;

a flue connected to said combustion chamber;

a blower assembly positioned to receive combustion products from said flue and including a blower and an air pressure sensitive switch positioned adjacent to said blower to detect flow of air and combustion products through said blower assembly; and a controller connected to said blower and said pressure sensitive switch, said controller being capable of checking the status of said switch prior to energizing said blower.

2. The water heater defined in claim 1 wherein said controller is capable of monitoring the status of said switch subsequent to energizing said blower.

3. The water heater defined in claim 2 further comprising a fuel valve connected to said controller and adapted to supply fuel to said burner, said controller being capable of producing an output to energize said fuel valve depending on the monitored status of said switch.

4. The water heater defined in claim 3 wherein said controller energizes said fuel valve a predetermined time subsequent to closure of said pressure switch.

5. The water heater defined in claim 1 further comprising a sensor positioned to detect the temperature of water in said water container and connected to said controller.

6. The water heater defined in claim 5 wherein said controller is capable of receiving temperature information from said sensor, comparing said temperature information with a predetermined temperature and initiating a heating sequence in said water heater.

7. The water heater defined in claim 5 wherein said sensor is a thermistor.

8. The water heater defined in claim 6 wherein said predetermined temperature is variable.

9. The water heater defined in claim 5 wherein said controller is capable of comparing temperature information received from said sensor with an over-temperature setpoint and deenergizing all controller outputs in response thereto.

10. The water heater defined in claim 9 wherein said controller permits reenergization of said controller outputs upon removing power for a predetermined time and subsequently reapplying power.

11. The water heater defined in claim 1 wherein said controller is capable of comparing temperature information received from a sensor positioned to detect the temperature of water in said water container with a predetermined temperature indicative of a desired heated water temperature and deenergizing said blower and a fuel valve adapted to supply fuel to said burner in response thereto.

12. The water heater defined in claim 1 further comprising a standing pilot burner positioned adjacent said burner.

13. The water heater defined in claim 4 wherein said predetermined time is about 8 seconds.

14. The water heater defined in claim 9 wherein said over-temperature setpoint is less than or equal to about 210° F.

15. The water heater defined in claim 6 wherein said predetermined temperature is about 90–180° F.

16. The water heater defined in claim 1 wherein said controller is capable of receiving temperature information from a remote air heating system connected to said water heater and shutting off supply of heated water to said air heating system when said temperature information is greater than a predetermined set point.

17. A water heater comprising:

a water container;

a combustion chamber adjacent said water container;

a burner associated with said combustion chamber;

a flue connected to said combustion chamber;

a blower assembly having a blower and positioned to receive combustion products from said flue;

an exhaust line connected to said blower assembly to convey said combustion products away from said blower assembly; and an air pressure switch positioned at said blower assembly adjacent to said blower to detect flow of air and combustion products through the blower assembly prior to initiation of combustion at said burner.

18. The water heater defined in claim 17 further comprising a controller connected to said pressure switch and capable of determining the status thereof.

19. The water heater defined in claim 18 wherein said controller is capable of providing an output to control said burner in response to the status of said pressure switch.

20. The water heater defined in claim 18 wherein said controller is capable of producing out output to energize a blower in said blower assembly in response to the status of said pressure switch.

21. The water heater defined in claim 20 wherein said controller is capable of monitoring the status of said switch subsequent to energizing said blower.

22. The water heater defined in claim 17 further comprising a fuel valve connected to said controller and adapted to supply fuel to said burner, said controller being capable of producing an output to energize said fuel valve depending on the monitored status of said switch.

23. The water heater defined in claim 22 wherein said controller energizes said fuel valve a predetermined time subsequent to closure of said pressure switch.

24. The water heater defined in claim 17 further comprising a sensor positioned to detect the temperature of water in said water container and connected to said controller.

25. The water heater defined in claim 24 wherein said controller is capable of receiving temperature information from said sensor, comparing said temperature information with a predetermined temperature and initiating a heating sequence in said water heater.

26. The water heater defined in claim 24 wherein said sensor is a thermistor.

27. The water heater defined in claim 26 wherein said predetermined temperature is variable.

28. The water heater defined in claim 24 wherein said controller is capable of comparing temperature information received from said sensor with an over-temperature setpoint and deenergizing all controller outputs in response thereto.

29. The water heater defined in claim 28 wherein said controller permits reenergization of said controller outputs upon removing power for a predetermined time and subsequently reapplying power.

30. The water heater defined in claim 17 wherein said controller is capable of comparing temperature information received from a sensor positioned to detect the temperature of water in said water container with a predetermined temperature indicative of a desired heated water temperature and deenergizing said blower and a fuel valve adapted to supply fuel to said burner in response thereto.

31. The water heater defined in claim 17 further comprising a standing pilot burner positioned adjacent said burner.

32. The water heater defined in claim 23 wherein said predetermined time is about 8 seconds.

33. The water heater defined in claim 10 wherein said over-temperature setpoint is less than or equal to about 210° F.

34. The water heater defined in claim 29 wherein said predetermined temperature is about 90–180° F.

35. The water heater defined in claim 17 wherein said controller is capable of receiving temperature information from a remote air heating system connected to said water heater and shutting off supply of heated water to said air heating system when said temperature information is greater than a predetermined set point.

* * * * *